US005988783A

United States Patent [19]

Tajika et al.

[11] Patent Number: 5,988,783

[45] Date of Patent: Nov. 23, 1999

[54] DEVICE AND METHOD FOR DETERMINING SUFFICIENCY OF INK SUPPLY FOR INK JET RECORDING APPARATUS

[75] Inventors: Hiroshi Tajika; Hiromitsu Hirabayashi, both of Yokohama; Atsushi Arai, Kasukabe; Noribumi Koitabashi; Yoshiaki Takayanagi, both of Yokohama, all of Japan

[73] Assignee: Canon Kabushiki Kaisha, Tokyo, Japan

[21] Appl. No.: 08/396,061

[22] Filed: Feb. 28, 1995

Related U.S. Application Data

[62] Division of application No. 07/931,784, Aug. 18, 1992, abandoned, which is a division of application No. 07/742,066, Aug. 7, 1991, Pat. No. 5,162,817, which is a continuation of application No. 07/470,745, Jan. 26, 1990, abandoned.

[30] Foreign Application Priority Data

| | | | |
|---|---|---|---|
| Jan. 28, 1989 | [JP] | Japan | 1-19076 |
| Jan. 28, 1989 | [JP] | Japan | 1-19077 |
| Apr. 28, 1989 | [JP] | Japan | 1-111178 |

[51] Int. Cl.[6] ..... B41J 2/175

[52] U.S. Cl. ..... 347/7

[58] Field of Search ..... 347/7; 73/304 R

[56] References Cited

U.S. PATENT DOCUMENTS

| | | | |
|---|---|---|---|
| 3,375,716 | 4/1968 | Hersch | 73/304 |
| 4,196,625 | 4/1980 | Kern | 73/304 R |
| 4,202,267 | 5/1980 | Heinzl et al. | 347/7 X |
| 4,313,124 | 1/1982 | Hara | 347/57 |
| 4,345,262 | 8/1982 | Shirato et al. | 347/56 X |
| 4,459,600 | 7/1984 | Sato et al. | 347/56 X |
| 4,463,359 | 7/1984 | Ayata et al. | 347/56 |
| 4,558,333 | 12/1985 | Sugitani et al. | 347/65 |
| 4,636,814 | 1/1987 | Terasawa | 347/7 X |
| 4,719,475 | 1/1988 | Kiyohara et al. | 347/7 X |
| 4,723,129 | 2/1988 | Endo et al. | 347/56 |
| 4,740,796 | 4/1988 | Endo et al. | 347/56 |
| 4,788,861 | 12/1988 | Lichti | 73/304 R |
| 5,162,817 | 11/1992 | Tasika | 347/7 |

FOREIGN PATENT DOCUMENTS

| | | | |
|---|---|---|---|
| 0261764 | 3/1988 | European Pat. Off. . | |
| 59-123670 | 7/1984 | Japan | B41J 3/04 |
| 59-138461 | 8/1984 | Japan | B41J 3/04 |
| 59-214656 | 12/1984 | Japan . | |
| 224549 | 11/1985 | Japan | B41J 3/04 |
| 62-015415 | 1/1987 | Japan . | |
| 63-132057 | 6/1988 | Japan . | |

*Primary Examiner*—Joseph W. Hartary
*Attorney, Agent, or Firm*—Fitzpatrick, Cella, Harper & Scinto

[57] ABSTRACT

An ink jet recording apparatus comprises a detachably mountable ink jet cartridge including an ink jet recording head for ejecting ink into a recording medium and an ink supply source containing ink for supply to the recording apparatus, which ink supply source has electrodes for passing an electric current through the ink in said ink supply source. A resistance-determining circuit determines a reference resistance between the electrodes by applying an electric current thereto when the ink jet cartridge is mounted to the apparatus and determines a test resistance between the electrodes by applying the same electric current thereto after a predetermined amount of recording. The reference resistance is used to calculate a threshold resistance, which is stored for comparison to the test resistance to judge whether or not the amount of ink in the ink supply source has dropped to a level unsuitable for recording.

25 Claims, 14 Drawing Sheets

DEVICE AND METHOD FOR DETERMINING SUFFICIENCY OF INK SUPPLY FOR INK JET RECORDING APPARATUS

This application is a division of application Ser. No. 07/931,784 filed Aug. 18, 1992, now abandoned, which in turn is a division of application Ser. No. 07/742,066 filed Aug. 7, 1991, now U.S. Pat. No. 5,162,817, issued Nov. 10, 1992, which in turn is a continuation of application Ser. No. 07/470,745 filed Jan. 26, 1990, now abandoned.

BACKGROUND OF THE INVENTION

1. Field of the Invention

The present invention relates to an ink jet head, ink tank and ink jet apparatus capable of preventing an erroneous detection due to change of ink component and having an improved ink residual quantity detecting means.

2. Related Background Art

Conventional means for detecting residual ink quantity used in ink jet recording apparatus are generally divided into the following three groups:

(1) Detection means wherein the residual ink detection is performed by detecting the change in resistance and turned ON or OFF in accordance with the presence or absence of ink between two electrodes;

(2) Detection means wherein the residual ink detection is performed by detecting the analogous change in volume of ink between two electrodes; and (3) Detection means wherein the residual ink detection is based on the resistance residing in an absorbent member between two electrodes.

However, in the conventional ink jet recording apparatuses, when a different color ink or different type ink (for being used with plain paper or coated paper) or OHP (transparency for OHP (overhead projection) (referred "TP" hereinafter) was used while including the same single residual ink detection means, there arose a problem that the erroneous detection was derived from the fact that the volume resistance of a respective ink is varied or changed in accordance with the change in ink components (caused when the kind of dyne and/or kind of solvents and/or ratio of composition are different).

Generally, the ink tank is constructed in the form of a cartridge which is exchanged when the ink is consumed, but when a variation among cartridges exists, there is a possibility that the detection accuracy might decrease in the construction in which residual quantity detection is effected by comparing the resistance value between the electrodes with a basic or reference value. Such disadvantage is caused by variation of the absorbing member in a cartridge having an absorbing member with ink impregnated thereinto for preventing the solution of gas and leakage of ink generated vibration of the ink by shock upon transportation or the like.

Recently, the skill for making the recording head and ink tank into cartridge-like construction (cartridge) has been developed, since the recording head can be manufactured cheaply or in low cost by using an electric-thermal converting member as an energy generating element for ink discharge. It is advantageous to impregnate the ink into the absorbing member because an ink head pressure (pressure generated at the discharge opening by water head difference) at the discharge opening of recording head can be stabilized. However, there is fear that detecting accuracy of the residual ink quantity might be decreased in the manner in which the residual ink quantity is judged by comparison of resistance value between the electrodes with a uniform reference value, because there is occurred air bubbles present upon the ink discharge in addition to the above variation of absorbing members.

SUMMARY OF THE INVENTION

An object of the present invention is to prevent occurrence of erroneous detection and to provide an ink jet recording head, ink tank and ink jet recording apparatus in which various qualities have been improved.

Another object of the present invention is to provide the ink tank and ink jet recording head capable of effecting the residual ink quantity detection of high accuracy and stability with relatively simple construction.

It is an object of the present invention to provide a device for detecting whether the amount of ink remaining in an ink supply source of an ink jet recording apparatus has reached a level unsuitable for recording, wherein the ink supply source includes electrodes for passing electric current through the ink in the ink supply source, the device comprising information determining means for determining reference information corresponding to a resistance by applying an electric current to the electrodes when the ink supply source has a known predetermined amount of ink therein and for determining test information corresponding to a resistance by applying an electric current to the electrodes when the ink supply source has an unknown amount of ink therein, and judging means for judging whether or not the amount of ink in the ink supply source has reached the level unsuitable for recording by determining a relation between the reference information and the test information.

It is another object of the present invention to provide an ink jet recording apparatus utilizing a detachably mountable ink jet cartridge including an ink jet recording head for ejecting ink onto a recording medium and an ink supply source containing ink for supply to said ink jet recording head, the ink supply source having electrodes for passing an electric current through the ink in said ink supply source, the apparatus comprising information determining means for determining reference information corresponding to a resistance by applying an electric current to the electrodes when the ink jet cartridge is mounted to the apparatus and for determining test information corresponding to a resistance by applying an electric current to the electrodes a predetermined time after the ink jet cartridge is mounted to the apparatus, and judging means for judging whether or not the amount of ink in the ink supply source has reached a level unsuitable for recording by determining a relation between the reference information and the test information.

It is yet another object of the present invention to provide a method of detecting when the ink level in an ink supply source for an ink jet recording apparatus has reached a level unsuitable for recording, the method comprising the steps of establishing a reference resistance by passing an electric current through the ink in the ink supply source when the ink supply source has a known predetermined amount of ink therein, determining a test resistance by passing an electric current through the ink in the ink supply source after a predetermined amount of recording by the ink jet recording apparatus, and comparing the test resistance with a standard resistance.

It is still another object of the present invention to provide a method of detecting when the ink level in an ink supply source for an ink jet recording apparatus has reached a level unsuitable for recording, the method comprising the steps of establishing reference information corresponding to a resistance by passing an electric current through the ink in the ink supply source when the ink supply source has a known predetermined amount of ink therein, calculating from the reference information threshold information representing a level of ink in the ink supply source unsuitable for recording, determining test information corresponding to a resistance by passing an electric current through the ink in the ink supply source after a predetermined amount of recording by the ink jet recording apparatus, and comparing the test information with the threshold information.

DESCRIPTION OF THE PREFERRED EMBODIMENT

The present invention intends to correct the resistance value change of ink due to difference of color i.e. dye or the like by using correcting means provided on a residual quantity detecting apparatus with respect to resistance value from the electrode for residual quantity detection.

According to the present invention, even if an ink having different component is used in the same or common head, residual quantity detection can be effected accurately.

According to the present invention, the proper threshold can be determined corresponding to the ink supply source, so highly accurate detection of residual ink quantity can be effected without being effected by variations of the ink tank including the ink absorbing member.

Incidentally, residual quantity detection can be carried out at the head side or the tank side. In addition, in order to prevent an ink liquid surface from assuming a wave condition due to vibration or shock upon movement of the carriage, it is possible to insert the absorbing member into the head and ink tank. In the correcting circuit, an element having equivalent resistance change can be added for correction. Furthermore, temperature of the printing apparatus and ink can be monitored and corrected corresponding to resistance change of the ink due to temperature, which can lead to more accurate residual quantity detection.

Embodiment 1

Figure 1:
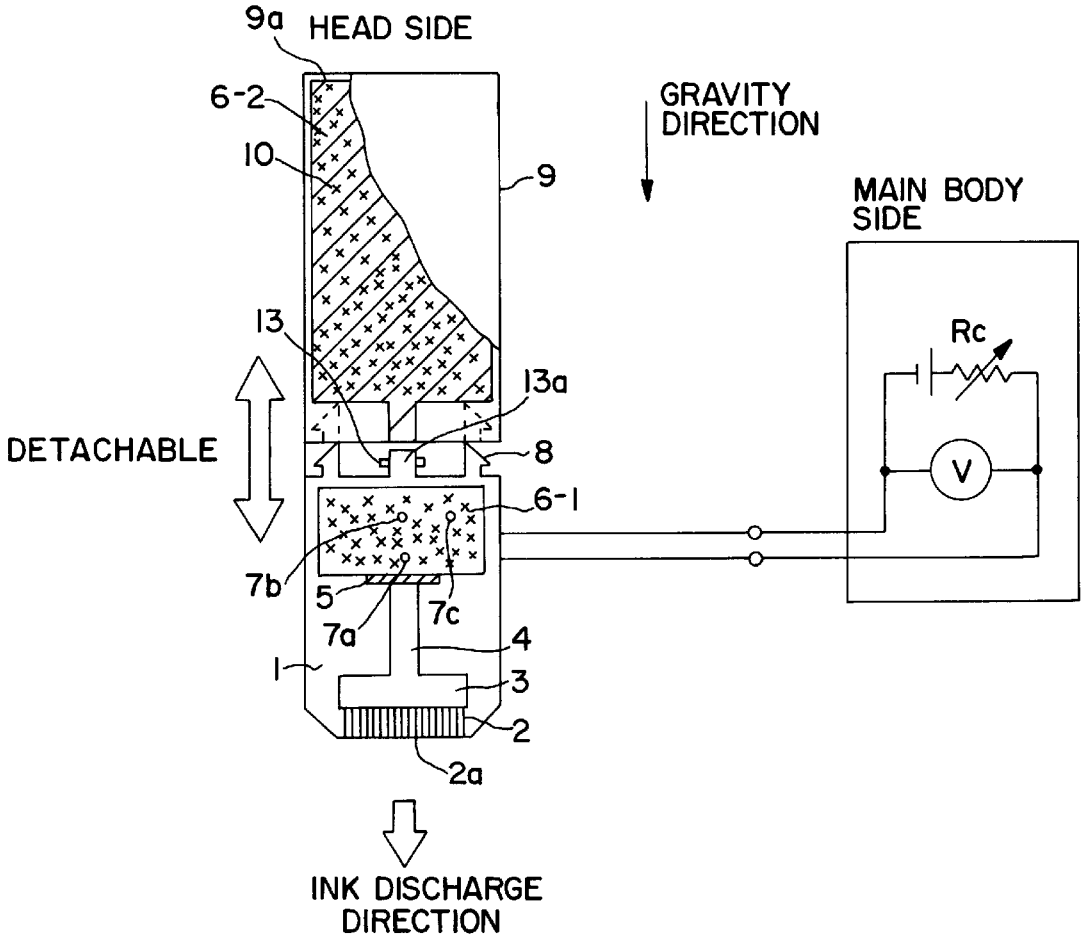
FIG. 1 is a schematic cross section showing one example of an ink jet recording apparatus including an ink jet recording cartridge according to the present invention.

FIG. 1 is a schematic view showing a disposable ink jet recording cartridge. On the cartridge, a recording head tip 1 and an ink tank 9 can be removably mounted. This cartridge is constructed so that the head pressure in the head tank 9 by single can be adjusted so as not to apply water head pressure onto the recording head tip 1 by inserting the absorbing member 6-2 into the ink tank 9. The recording head permits the recording or printing in the downward direction.

In FIG. 1, the reference numeral 1 denotes the above-mentioned recording head tip; and 2 denotes an ink discharging portion having the ability for discharging ink and including an ink discharge opening 2*a* and an ink path provided with energy generating means for generating thermal energy used for discharging the ink droplet and communicated with the discharge opening. The reference numeral 3 denotes a liquid chamber for temporarily reserving the ink to be sent the ink to the ink discharging portion; 4 denotes a flow passage for sending the ink to the liquid chamber; and 5 denotes a filter for removing bubbles and/or dust and the like. The reference numeral 6-1 denotes the above-mentioned absorbent member made of porous material or fiber material, and pin-shaped residual ink quantity detection electrodes 7*a*, 7*b* and 7*c* are arranged in the recording head wall to be inserted into the absorbent member 6-1. These elements constitute the recording head tip 1.

The reference numeral 9 denotes the above-mentioned ink tank, within which the above-mentioned absorbent member 6-2 and ink 10 are accommodated. 9*a* is a hole formed on the ink tank to be communicated with atmosphere. The ink tank 9 and the recording head tip 1 are removably combined with each other through insertion pins 8 and the like. In order to prevent leakage of the ink, O-ring 13 is provided. It is so designed that, when the ink tank 9 itself is stored, the ink therein does not lead from the ink tank, but, when it is combined with the recording head tip, the ink can flow from the ink tank to the recording head tip via an ink supplying part 13*a*.

Figure 3:
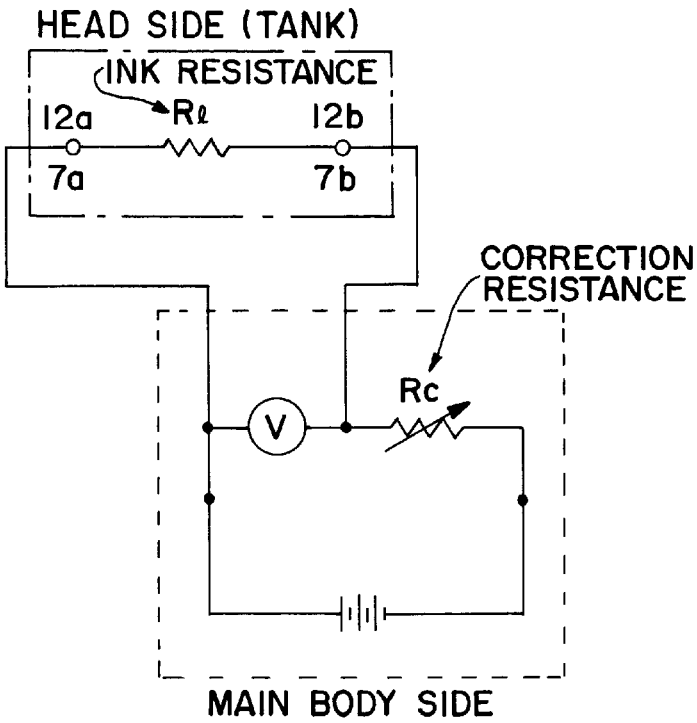
FIGS. 3 and 5 are drawings showing detecting circuits for residual ink quantity.
Figure 7:
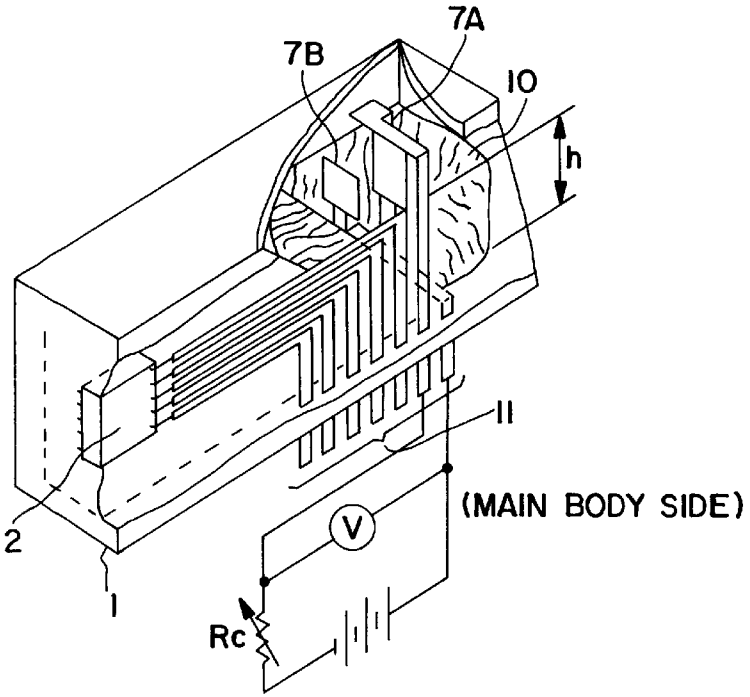
FIGS. 6 and 7 are schematic cross section and perspective views showing another embodiment of the ink jet recording cartridge according to the present invention.

Next, an electrical connection between the ink jet recording cartridge and a body of the recording apparatus itself will be explained. Although not shown in FIG. 1, as shown in FIG. 7, the recording head tip has a wiring member 11 (referred to as "lead frame" hereinafter) constituted by a plurality of plate-shaped conductors arranged side by side, and the reference numeral 12*a*, 12*b* and 12*c* (FIG. 3) denote electrodes incorporated into the lead frame 11 to detect the residual ink quantity (described later) and connected to the residual ink quantity detection means having a correction means for correcting the resistance at the main body side in accordance with the difference in the ink composition. The lead frame 11 is embedded in a casing made of, for example, resin, and the electrodes 12 correspond to the residual ink quantity detection electrodes 7, respectively, so that the residual ink quantity detection electrodes 7 are exposed into the absorbent member 6-1 to measure the ink resistance value, for example, between the electrodes 7*a* and 7*b* thereby detecting the residual ink quantity.

Figure 2:
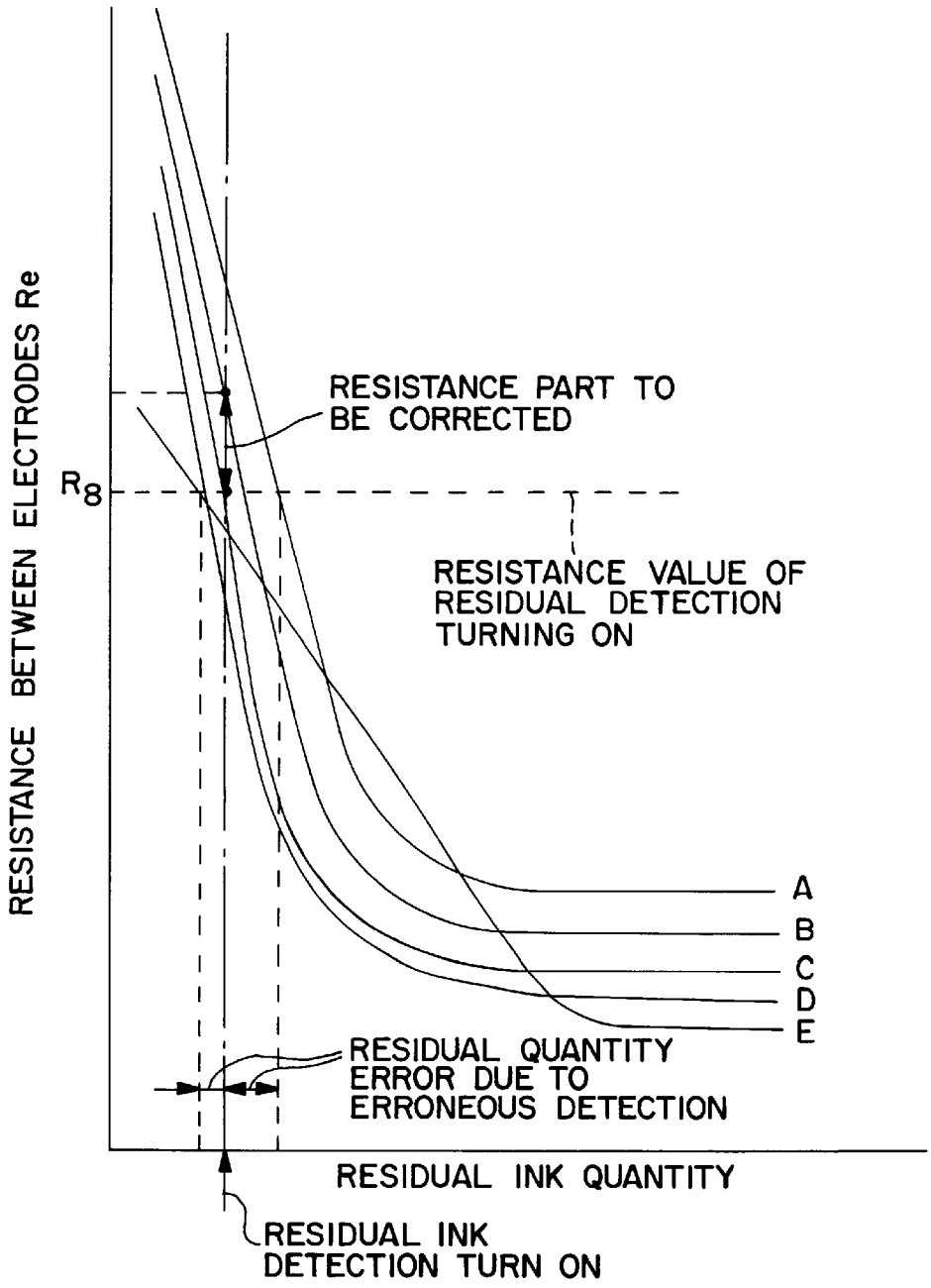
FIGS. 2 and 4 are graphs showing relation between the residual ink quantity and resistance between electrodes.

Next, the concrete method for detecting the residual ink quantity will be explained. When the amount or quantity of the ink in the ink tank 9 is reduced by consuming the ink in the ink tank 9 during the recording or printing operation and/or the ink recovery operation, the quantity of the ink included in the absorbent member 6-1 is also reduced, with the result that small bubbles are introduced into the absorbent member to gradually increase the electrical resistance between the electrodes 7*a* and 7*b*. Consequently, it is possible to detect the fact that the residual ink quantity reaches its lower limit, by detecting the reduction of the current between the electrodes. By monitoring the value of such current, it is possible to know the relation between the residual ink quantity l and the resistance of the ink R (between the electrodes). In FIG. 2, the curves A, B, C and D show the difference in the ink colors (the difference in the dyne), and the curves A, B, C, and D and E correspond to black ink (dyne density of 3.0%), red ink (dyne density of 2.5%), blue ink (dyne density of 2.5%), green ink (dyne density of 2%) and fresh tint ink (dyne density of 2.5%), respectively.

As seen from FIG. 2, since the respective volume resistance of the ink varies in accordance with the color thereof, in the case a detection lamp is turned on by activating the residual ink quantity detection means whenever the same resistance value $R_R$ is obtained between the electrodes 7*a* and 7*b* to detect the residual ink quantity therebetween, there will arise the difference in the residual quantity for each ink A, B, C and D, thus leading in the unfavorable result. In order to activate the residual ink quantity detection means when a certain predetermined residual quantity is reached for any ink A, B, C and D, it is desirable that the detection lamp regarding the residual quantity detection electrodes is turned on when the resistance value $R_R$ is obtained, by correcting the curves (FIG. 2) wholly by changing a correction resistance $R_C$ in the residual quantity detection circuit at a main body side shown in FIG. 3 to vary the difference in the resistance values between the inks A, B, C and D (for example, when the ink D having a low resistance value is used, by increasing the correction resistance $R_C$ to increase an apparent resistance ($R=p\cdot l/s$; here, p is specific resistance, l is length, s is area) of the ink D. On the other hand, if the ink A having a high resistance value is used, the detection lamp may be turned on when the resistance value $R_R$ is obtained by correcting the curves wholly by decreasing the correction resistance $R_C$ to decrease the apparent resistance of the ink A. Further, as to the ink E having the different resistance value, similarly, the correction resistance $R_C$ may be changed to obtain the same residual quantity in response to the resistance value $R_R$.

Figure 4:
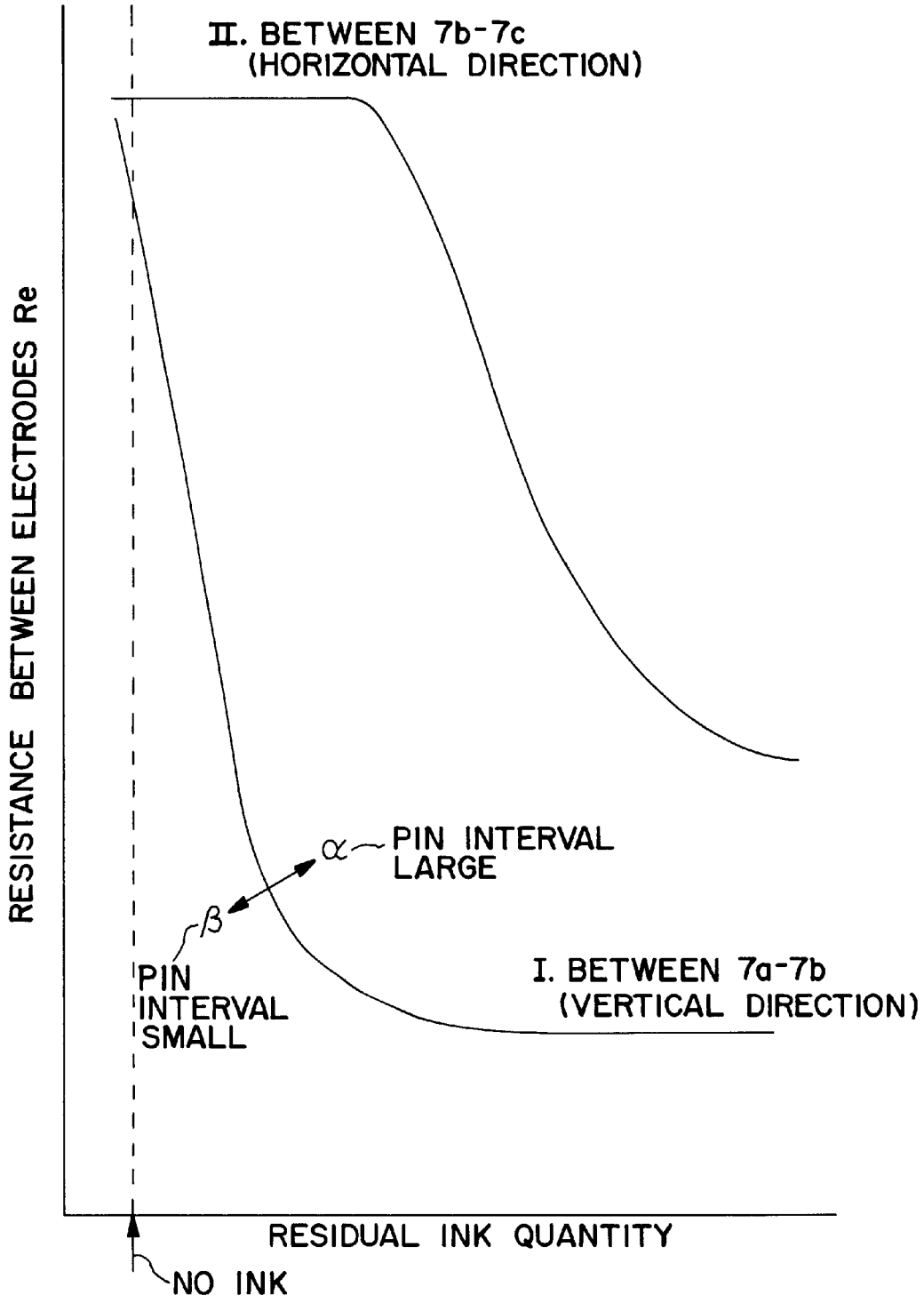

In this case, it is desirable to combine the residual quantity detection electrodes so that they are positioned to overlap in the gravity direction (The electrodes may be arranged along the oblique direction). FIG. 4 shows graphs indicating the resistance values measured in the vertical direction and in the horizontal direction. In the apparatus shown in FIG. 1, the resistance between the electrodes 7*a* and 7*b* may be detected. However, when the apparatus is arranged in the horizontal direction, the resistance between the electrodes 7*b* and 7*c* may be detected. Further, it should be noted that the distance between the electrodes 7 is shifted in the a direction when the distance is long or in the B direction when the distance is short. Each of the electrodes is preferably coated by high anti-corrosive layer such as SUS, gold-plating, platinum and the like. Incidentally, the distance between the electrodes varies in accordance with the structure of the absorbent member 6-1 of the head tip, and is preferably about 5–30 mm. In this case, the resistance of the ink has a value included in a range between a few tens of kQ. In the printing or recording apparatus for performing the printing operation by using such ink jet recording cartridge, the following test was carried out. That is to say, after the residual quantity detection lamp has once been turned ON, the ink C was replaced by the ink B. Thereafter, the correction resistance $R_C$ was manually varied to obtain a predetermined resistance value (in this example, while the correction resistance was varied manually, it may be varied automatically by using an appropriate means), and the residual quantity detection lamp was turned ON again. In this condition, the residual ink quantities in the two ink tanks were detected. As a result, it was found that there was substantially no difference in the residual quantities of the inks C and B in the ink tanks. However, when the ink is replaced by the different ink, it is desirable that the printing operation is started after the color of the old ink has been completely removed in the apparatus by repeating the recovery sequences regarding the new ink a predetermined number of times.

With the arrangement as mentioned above, it is possible to correctly detect the residual ink quantity by performing the same operation as mentioned above even if the ink tanks are changed on the way of the printing cycles.

Figure 5:
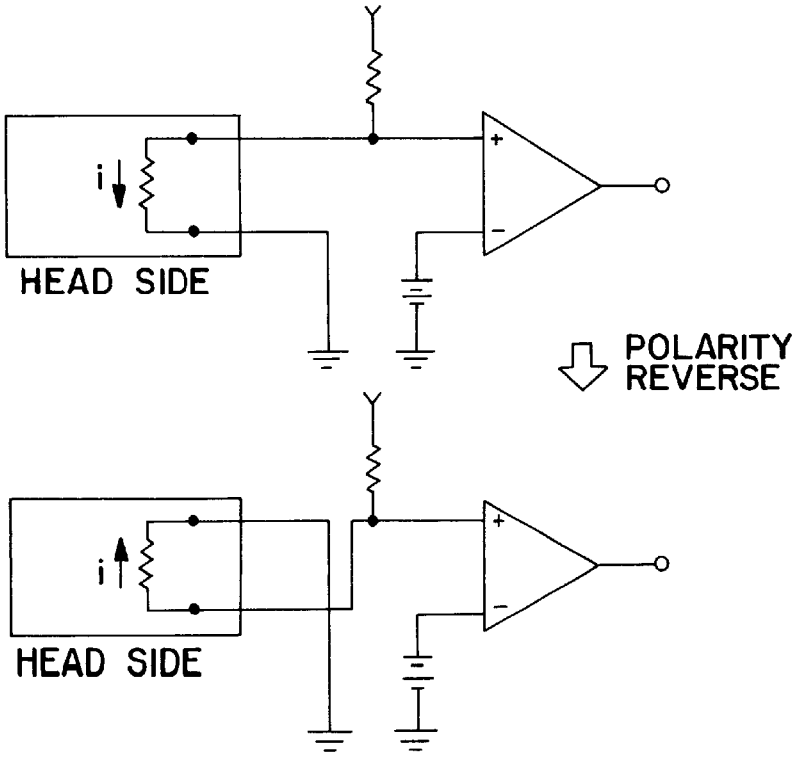

Further, the residual ink quantity detection circuit adopted to the present invention may be constituted as shown in FIG. 5, since, when the circuit is always being energized, there is the danger of generating the bubbles due to the electrolysis of the ink. In this way, it is possible to perform one measurement for a short time, and also it is possible to completely avoid the generation of the bubbles due to the electrolysis of the ink by reversing the polarity for each measurement. The time required for one measurement is in the order of a few msec.

Further, by providing pins for discriminating or detecting the difference in the colors at the cartridge side and by communicating the pins with the main body after mounting the cartridge on the apparatus, the correction resistance may be changed.

Embodiment 2

Figure 6:
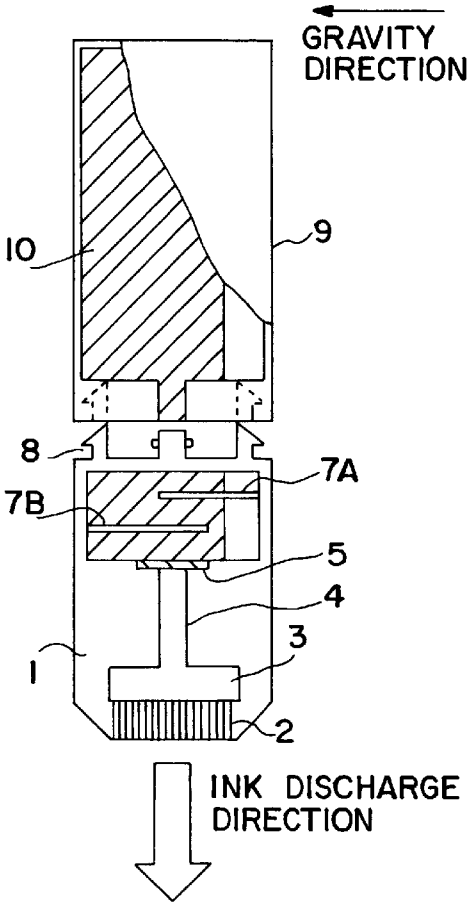

FIGS. 6 and 7 are sectional view and perspective view, respectively, of an ink jet recording cartridge (the second embodiment) of the present invention. In this second embodiment, by providing the correction resistance $R_C$ in a detection portion at the main body side, the difference in the resistance of the ink due to the difference in the composition of the ink, i.e., the difference in mixture ratio of the solvent, is corrected, whereby the resistance output feature of the recording apparatus is standardized.

FIG. 6 shows a disposable ink jet recording cartridge. Also on this cartridge, the recording head tip 1 and the ink tank 9 can be removably mounted. Since this cartridge does not include an absorbent member in the ink tank, the head pressure of the tank must be maintained by the meniscus at the discharge openings of the discharging portion. Accordingly, this cartridge is used in the recording apparatus which permits recording in the horizontal direction. The mounting and dismounting of the cartridge can be performed in the same manner as the previously described first embodiment. The features of the cartridge of the second embodiment are the fact that the absorbent member is not included also at the recording head tip side and that the plate-like residual ink quantity detection electrodes 7A and 7B are arranged in an ink supplying chamber so as to detect the ink resistance between the electrodes 7A and 7B varied in accordance with a height h of the ink surface as showing in FIG. 7, thereby detecting the residual ink quantity.

For example, since the compositions of the optimum inks for the plain paper, coated paper, TP and the like are different from each other, the resistance values of these inks are also different from each other. As for such difference in the resistance value, by changing the correction resistance $R_C$ to always maintain the apparent resistance value to the constant value, it is possible to correctly detect the residual ink quantity even if the inks are changed.

In the illustrated embodiment, while the correction circuit was provided at the main body side, the correction may be effected by any circuit equivalent to the ink. Further, while the variable correction resistance was used, the correction may be effected by changing over resistors connected in series or in parallel to each other.

Next, an ink jet recording apparatus according to a third embodiment of the present invention will be explained.

Embodiment 3

Figure 8:
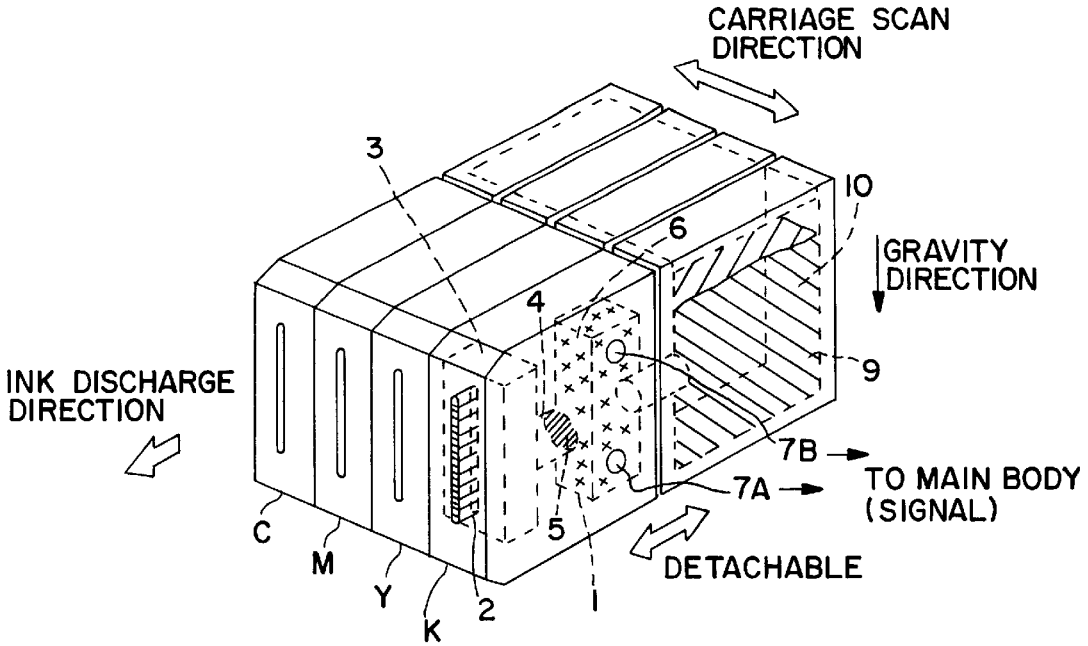
FIG. 8 is a schematic perspective view showing another embodiment of the ink jet recording cartridge according to still another embodiment of the present invention.

FIG. 8 is a perspective view showing the third embodiment of the present invention. In this embodiment, a full color printing can be performed by using four ink jet recording heads. In order to perform full color printing, although four kinds of inks, i.e., cyan ink, magenta ink, yellow ink and black ink must be used, if four residual quantity detection means suitable to the respective ink colors are incorporated in each of four recording heads, the whole ink jet recording apparatus will be very expensive.

Accordingly, in the third embodiment, although the head side may be identical with those of the previous embodiments, the main body side is so designed that the signal values from the respective inks C (cyan), M (magenta), Y (yellow) and K (black) are corrected so that the detection lamp is turned ON when the residual quantities of the inks C, M, Y and K are the same. Since each ink tank can be replaced by a new one independently, the ink in the ink tank can be used at is maximum extent without the erroneous detection, thus permitting reduction of the running cost of the apparatus. Further, if a plurality of recording heads are used, it is possible to prevent damage of the heads due to the introduction of the bubbles into the discharging portions of the heads caused by the erroneous detection.

Embodiment 4

In this embodiment, by changing position of the electrode for residual quantity detection of the head side relative to the resistance change of ink resulted from difference of the ink i.e. dyne, the resistance correction based on distance is carried out to equalize the resistance output characteristic to the main body of printing apparatus.

Figure 9:
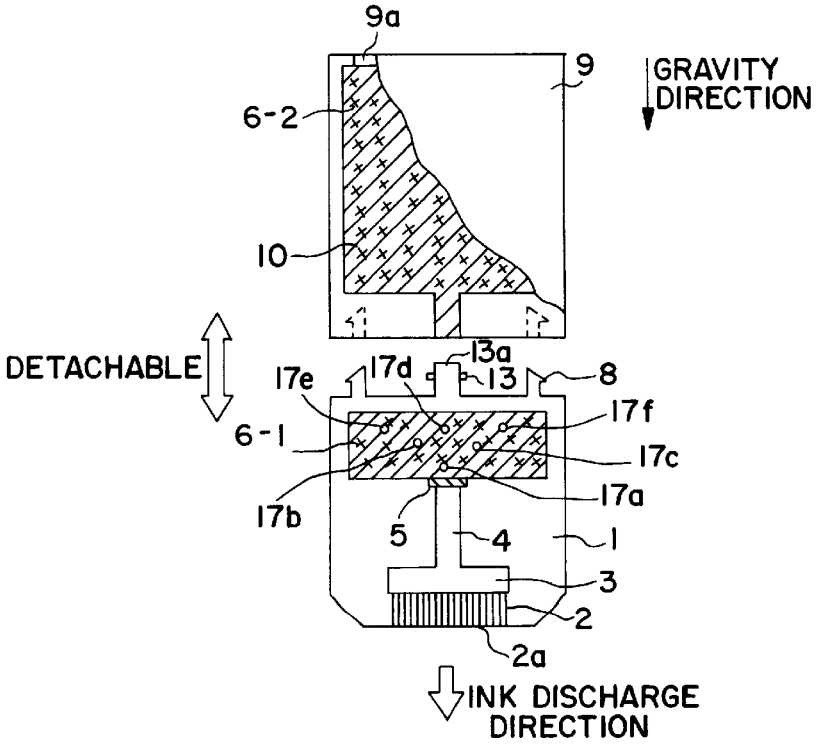
FIG. 9 is a schematic cross section showing still another embodiment of the ink jet recording cartridge according to the present invention.

FIG. 9 is a schematic view of the ink jet recording cartridge of disposable type according to the present invention.

This Embodiment 4 differs from the above Embodiment 1 in the construction that the pin-like electrodes 17*a*, 17*b*, 17*c*, 17*d* and 17*e* for ink residual quantity detection are provided on the recording head wall so that they are inserted into the ink absorbing member 6-1 made of porous or fiber like material. Explanation of another elements similar to the above Embodiment 1 is omitted by adding same or corresponding numerals for clarification.

Next, the concrete method of ink residual quantity detection of this embodiment will be explained.

In this embodiment, in order to achieve the residual quantity detection at a predetermined level for each of inks A, B, C and D, the resistance value difference of the inks A, B, C and D are changed by a changing apparatus. For example, in the case using the ink D of low resistance value, the distance between electrodes is selected long to thereby set the apparent resistance R=P⅕ (P: resistance ratio, l: length, S: area). Consequently, the curve is entirely corrected to turn on the residual quantity detection when the resistance value is $R_B$. On the other hand, when using the ink A of high resistance value, the distance between electrodes is selected short to set the apparent resistance small. Consequently, the apparent resistance is corrected entirely so that the residual quantity detection will be operated when resistance value is $R_B$. For the ink E of different resistance value variation, the position of electrodes are combined so that residual quantity becomes equal when the resistance is $R_B$.

Figure 10:
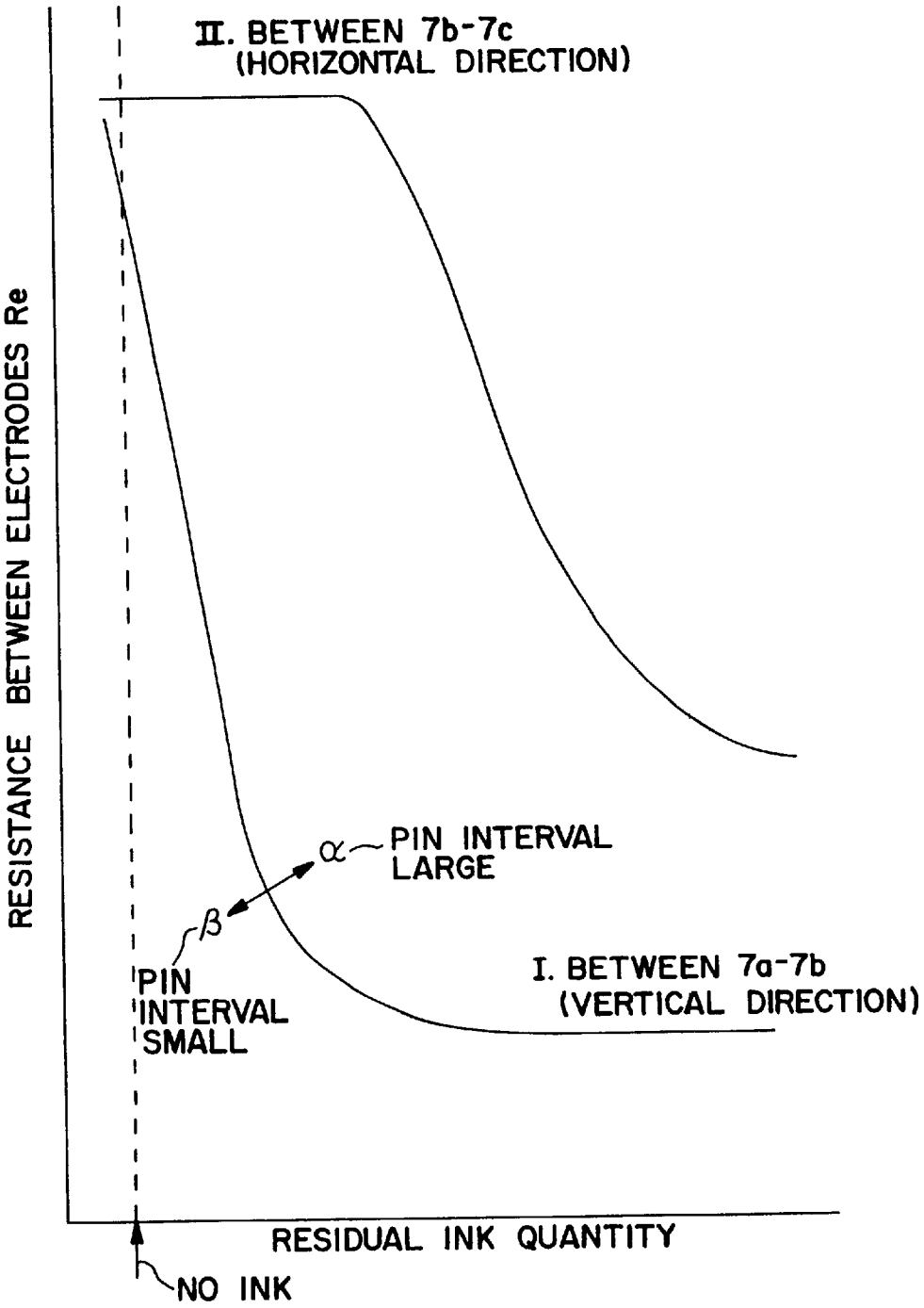
FIG. 10 is a graph showing relation between the residual ink quantity and resistance between electrodes.

Preferably they are combined in upper-lower relation (oblique positioning is possible) with respect to the gravity direction. The graph obtained by measuring the resistance value in the vertical and horizontal directions relative to the gravity direction is shown in FIG. 10. Needless to say, the interval of detecting electrode is shifter to a direction or B direction as the distance becomes longer or shorter.

In the printing apparatus printing with this cartridge, the ink C is exchanged to ink B after turn on of the ink residual quantity detecting lamp, the electrode position is exchanged from 17*a*–17*e* to 17*a*–17*d*.

The lamp is turned on again, and residual ink quantity is detected to reach the result that there is found no difference therebetween. In connection with this, it is preferable to absorb and replace the ink by a constant recover sequence after the ink is replaced by another ink, and carry out printing after the color change has been completely finished. Furthermore, more accurate residual quantity detection becomes possible by adding the above process even in the course of ink tank exchange in the printing process.

Embodiment 5

Figure 11:
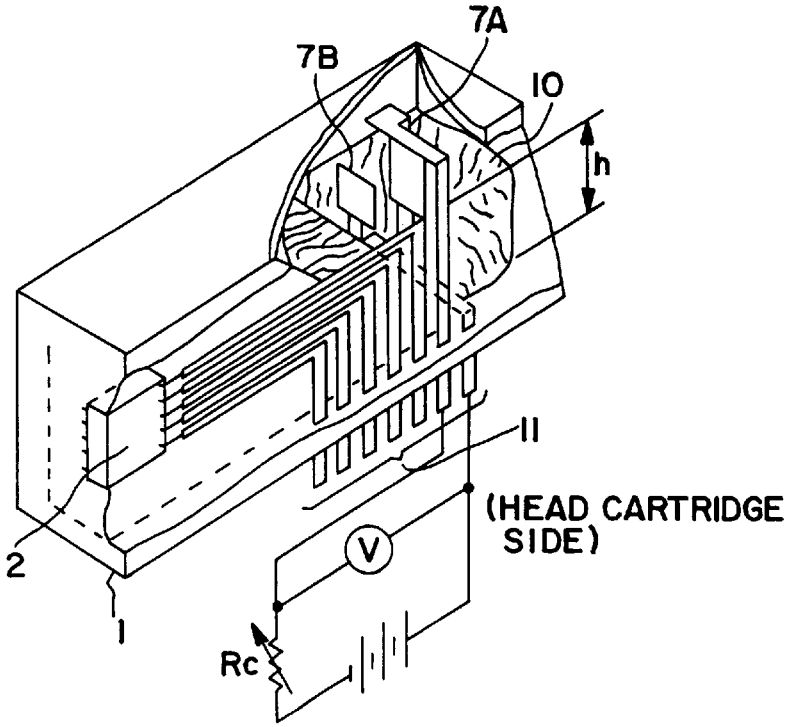
FIG. 11 is a schematic perspective view showing still another embodiment of the ink jet recording cartridge according to the present invention.

The fifth embodiment of the present invention will be explained with reference to FIGS. 6 and 11.

In this embodiment, the resistance value change or variation due to difference of mixing ratio of the soluble agent, i.e. difference of composition of the ink is corrected by adding a correcting resistance $R_C$ at a detecting portion of the head cartridge, so that the resistance output characteristic to the main body of printer becomes equal.

In this embodiment, the residual quantity detection is effected by detecting the ink resistance between the electrodes 7A and 7B. However, by making the correcting resistance $R_C$ provided on the cartridge changeable relative to the resistance value variation due to the ink component, it becomes possible to keep the artificial resistance value constant and thereby accurate residual quantity becomes possible as for the ink exchange.

In the above embodiment, the simple correcting circuit is added to the head cartridge, but the correction can be made by a circuit equivalent to the ink. Additionally, although variable type correction resistance is used, it is possible to switch the resistances connected in serial or parallel. Switching can be effected manually or automatically.

Embodiment 6

Figure 12:
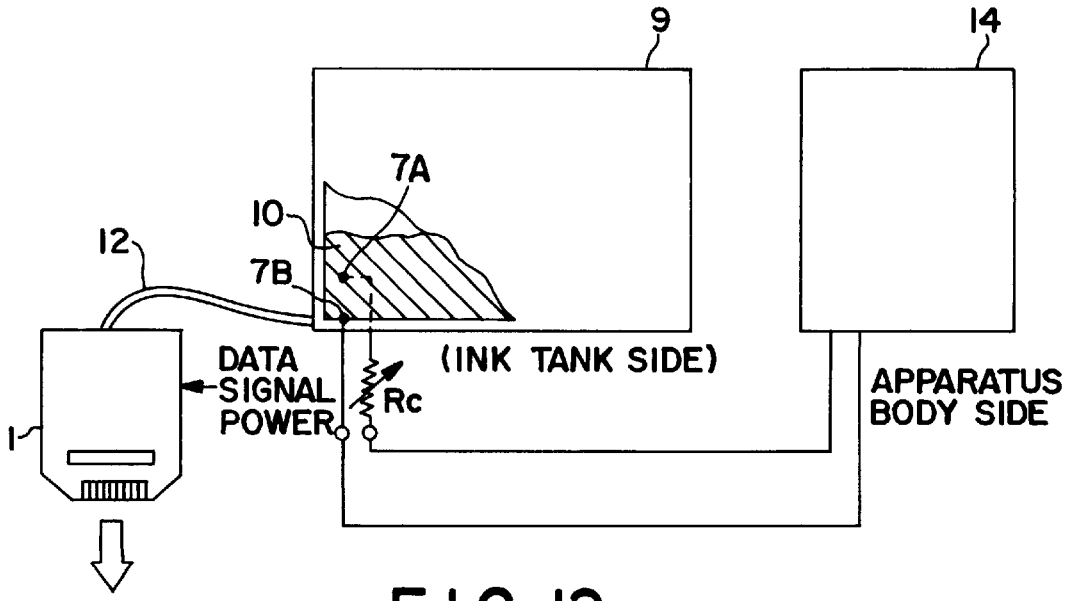
FIG. 12 is a schematic drawing showing an example of ink jet recording apparatus including an ink tank according to the present invention.

FIG. 12 is a schematic view showing the sixth embodiment of the present invention. In this embodiment, the variation of ink resistance value accompanied by change of dyne density of ink is overcome by adding the correction resistance $R_C$ to the tank. The ink jet recording apparatus shown in FIG. 12 is constructed as a so-called permanent type having a lifetime as long as the main body of the apparatus, in which the recording head 1 mounted on the carriage (not shown) and the ink tank 9 is connected via an ink supplying tube 12. 14 shows detecting circuit for ink residual quantity provided the main body of apparatus.

This embodiment is constructed so that the bubble may not enter into the head by reducing the mounting parts of the head portion, increasing responsibility of the head itself and effecting the residual quantity detection at tank side. With such construction, bad or poor printing (non-discharge) resulting from bubble entry into the discharge portion due to erroneous detection can be prevented.

In the above-mentioned first, second and third embodiments, while the resistance value itself was corrected, the current value or voltage value generated in accordance with the change in the ink resistance value may be effected by correction relative to change.

Further, the following alterations or modifications may be adopted:

analog detection or digital detection may be used;

the changing of the correction resistance may be effected manually or automatically;

the recording head may be a disposable type head or a permanent type head having a lifetime equivalent to the main body of apparatus;

the electrodes may be arranged at the tank side or at the head tip side;

the ink may be accommodated in the tank with or without the absorbent member;

the correction is not necessarily performed in analog fashion and continuously, and, thus, may be changed digitally or may be changed with the use of any conversion table; and the correction may be used for the detection of the residual ink quantity with the change in the ink resistance due to the difference in temperature of the ink caused by the change in ambient conditions.

Embodiment 7

This is an embodiment of ink jet recording apparatus in which and from which the head the cartridge of disposable type in which the recording head and ink tank are made integral each other.

Figure 13:
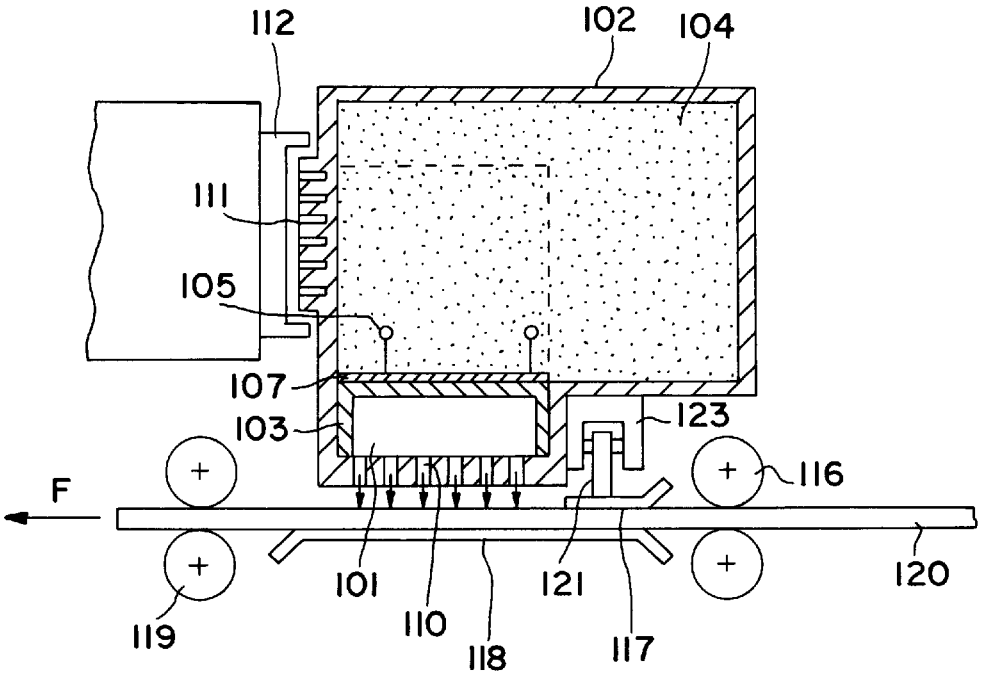
FIG. 13 is a schematic cross section showing still another example of the ink jet recording apparatus including the ink jet recording cartridge.

In FIG. 13 showing cross section of the ink jet recording apparatus including the head cartridge according to the seventh embodiment of the present invention, reference numeral 101 shows a recording head chip corresponding to a main portion of the ink jet recording head, which head chip discharges the ink under movement opposing to a recording medium 120 corresponding to the recording signal. This constant current circuit to be explained in FIG. 16 later.

Figure 15:
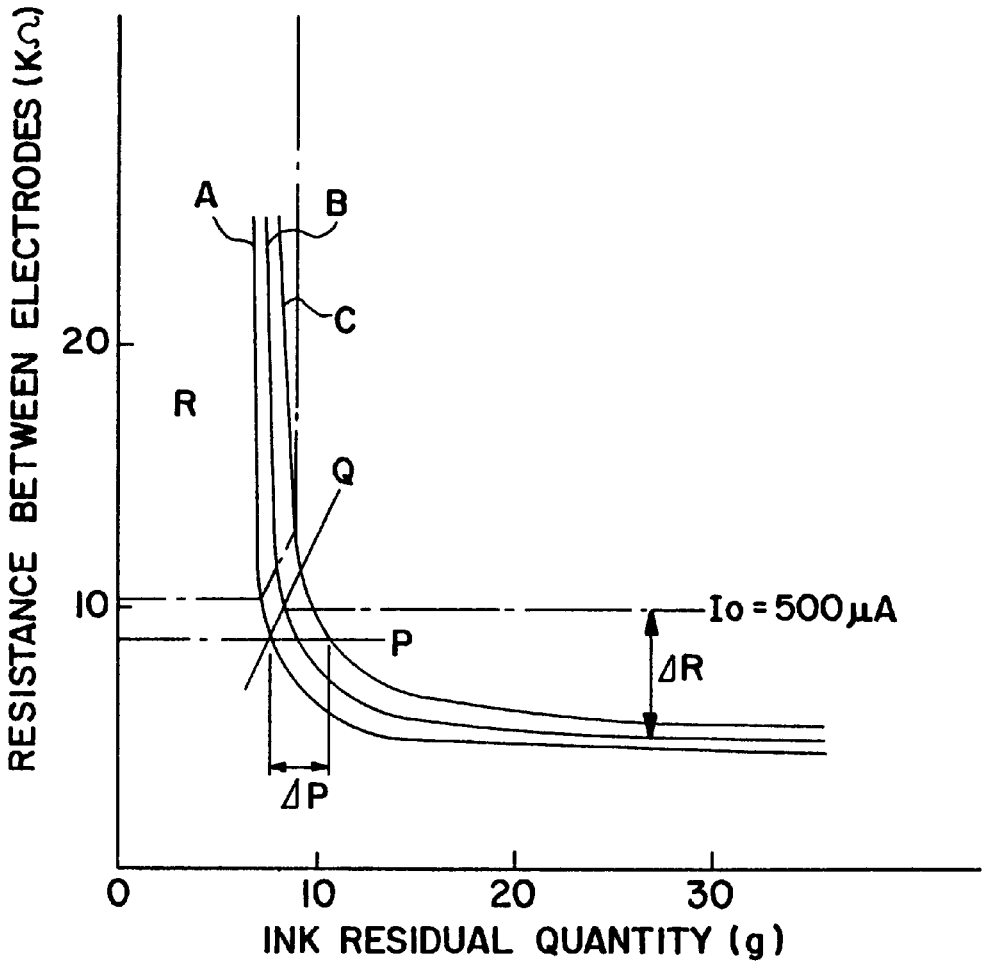
FIG. 15 is a still another graph showing the relation between the residual ink quantity and resistance between electrodes resulting from variation the ink jet recording cartridge.

As mentioned above, since there occurs characteristic variation of among each of cartridges as shown in FIG. 15, if the threshold is determined simply as a point P as shown in FIG. 15, there occurs variation of residual ink quantity upon detection by ΔP (about 4 kg). This corresponds to 200 sheets (A4 size) with standard letter recording, and 40 to 60 sheets with image recording, which leads to deterioration of the detecting accuracy.

For overcoming the above defect, an area R where the recording becomes impossible is obtained by experiment as shown in FIG. 15. A recording chip is comprised of a print plate 103 having a base plate (heater board) on which the electric-thermal converting member (discharge heater) as discharge energy generating element and wiring parts therefor, and a line 110 of the discharge opening or liquid path corresponding to the discharge heater.

An ink tank 102 has an absorbing member 104 made of porous material and impregnated with predetermined quantity of ink, and a pair of electrodes for residual ink quantity are inserted into the absorbing member 104. The ink tank portion 102 and ink head chip are connected each other to construct the head cartridge, 107 is a porous filter provided between the ink tank and head chip and having an outer diameter which does not allow the air bubbles to pass easily.

For discharge energy generating element such as electric-thermal converting member disposed in the liquid path line 110 and generating energy for ink discharge and pin-like electrode 105 for residual ink quantity detection inserted into the absorbing member 104, the electrodes for realizing the electric connection therewith are gathered in the form of electrode line 111. The electrode line 111 is connected with a connector 112 of the recording apparatus main body side.

Upon recording by the recording apparatus of this embodiment, to the recording medium 120 conveyed in the P direction by supply roller pair 116 and discharge roller pair 119, a carriage scanning is carried out with the recording medium 120 being pressed onto a guide 118 by a sheet pressing rail 117 via a roller 121 of the carriage 122 which is scanned along a carriage axis 122.

Figure 14:
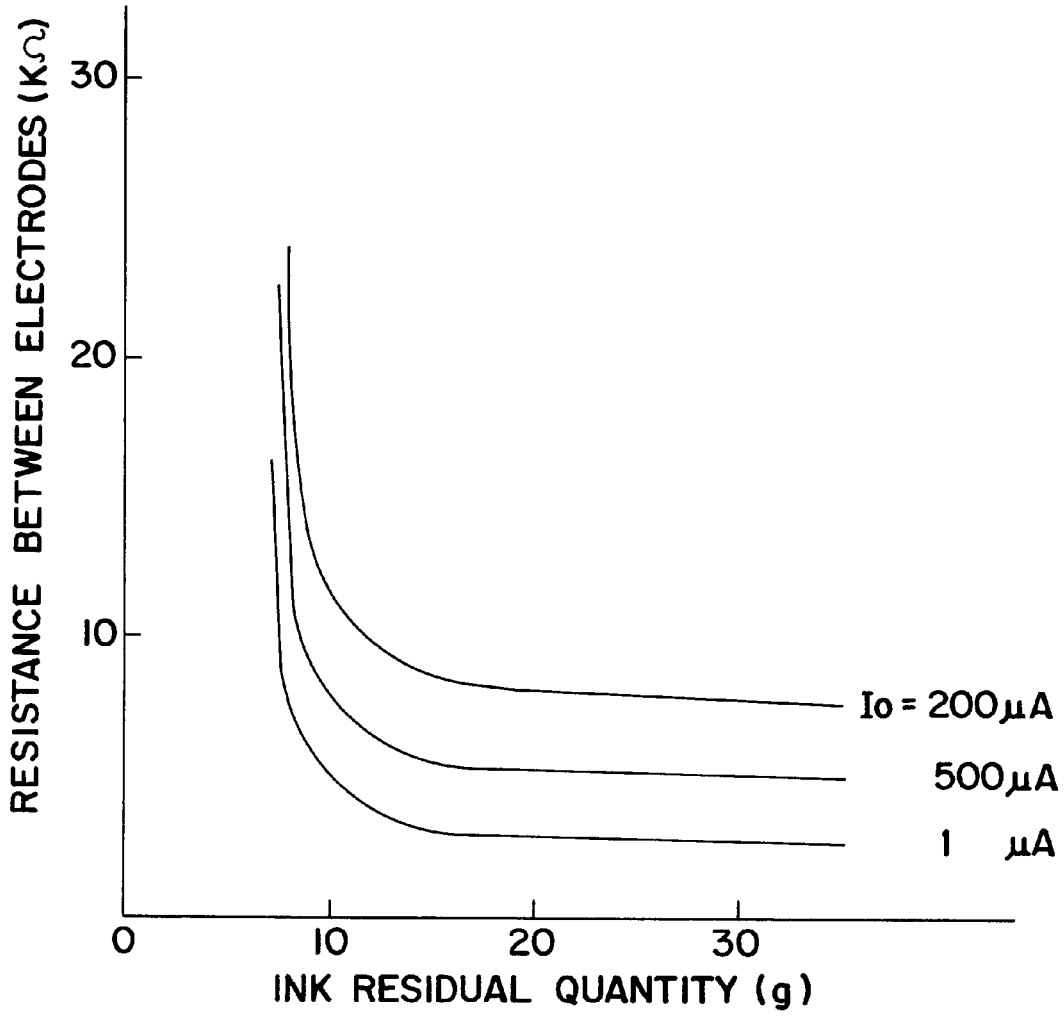
FIG. 14 is a graph showing the relation between the residual ink quantity and resistance between electrodes.

In the present embodiment, the residual ink quantity detection in the ink tank 102 is basically carried out based on the resistance value between the electrodes 105. However, the residual ink quantity detection might not be carried out accurately by adopting the circuit construction such as resistance dividing method because the relation between residual ink quantity and resistance between electrodes may vary depending on current supplied between both electrodes, as shown in FIG. 14. Here, the residual ink detection is carried out by using the area selected as the threshold. In detail, the point Q is initially determined corresponding to an initial value of resistance between the electrodes of cartridge, then absence of residual ink is judged by a judging means when the point reaches to a resistance difference, thereafter sequence of the main body is properly controlled and alarm is displayed for an operator. For that, either data of the initial value or threshold (on the line Q) obtained therefrom is read into the non-volatile memory, and held as an information regarding to the cartridge mounted even when power is OFF.

Figure 16:
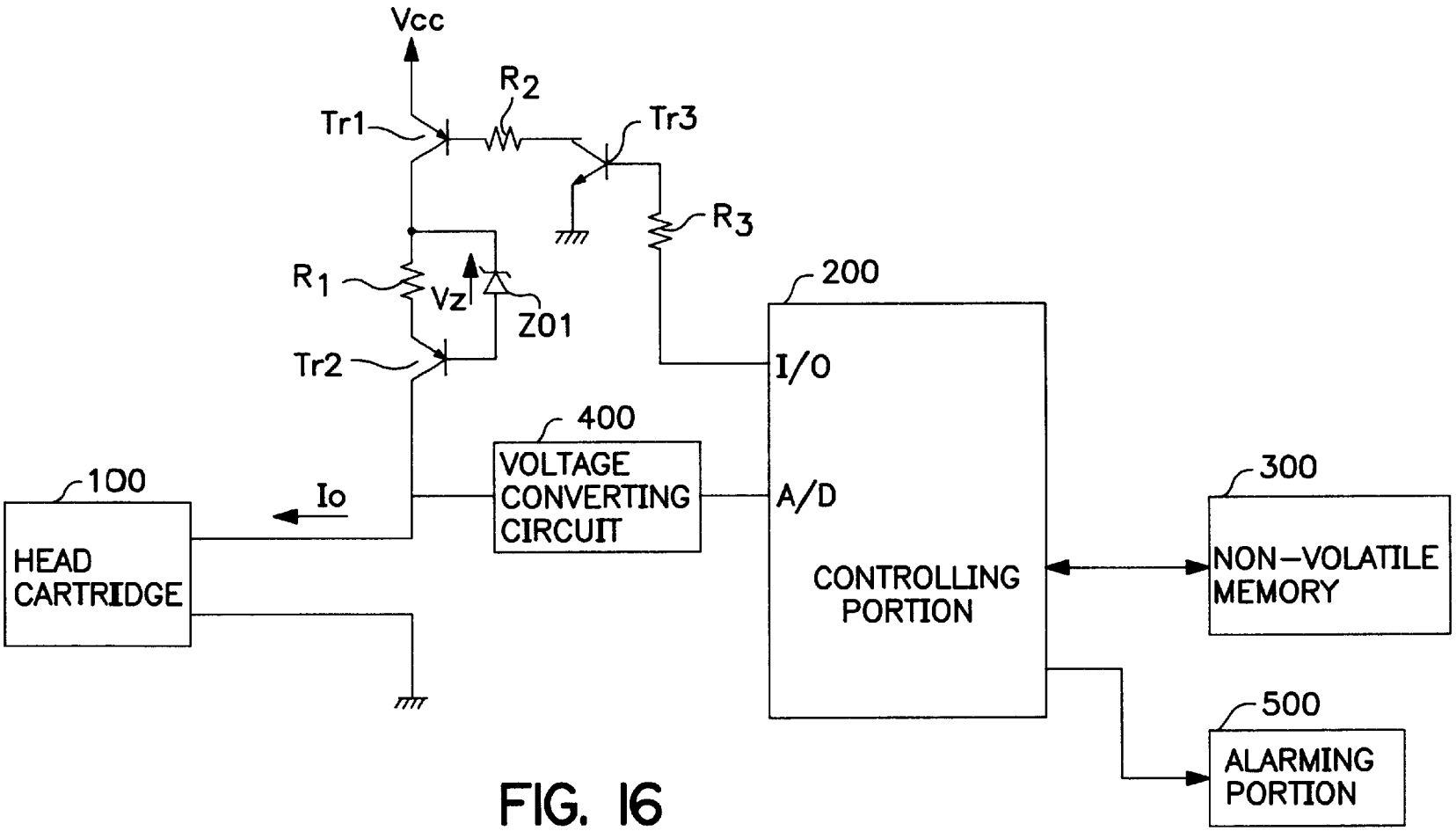
FIG. 16 is a drawing showing still another example of a detecting circuit of residual ink quantity.

FIG. 16 shows an example of a detecting circuit for residual ink quantity for achieving the above treatment or process, which includes a resistance determining means for determining the resistance between the electrodes 105, as described below. In FIG. 16, 100 shows the head cartridge of disposable type shown in FIG. 13, 200 shows a controlling portion of microcomputer type having for example a A/D convertor, 300 shows a non-volatile memory comprised of for example EEPROM or the like, 400 is a voltage converting circuit, and 500 shows a displayer and/or alarming portion for alarming the head cartridge to be exchanged when no residual ink is left.

Figure 17:
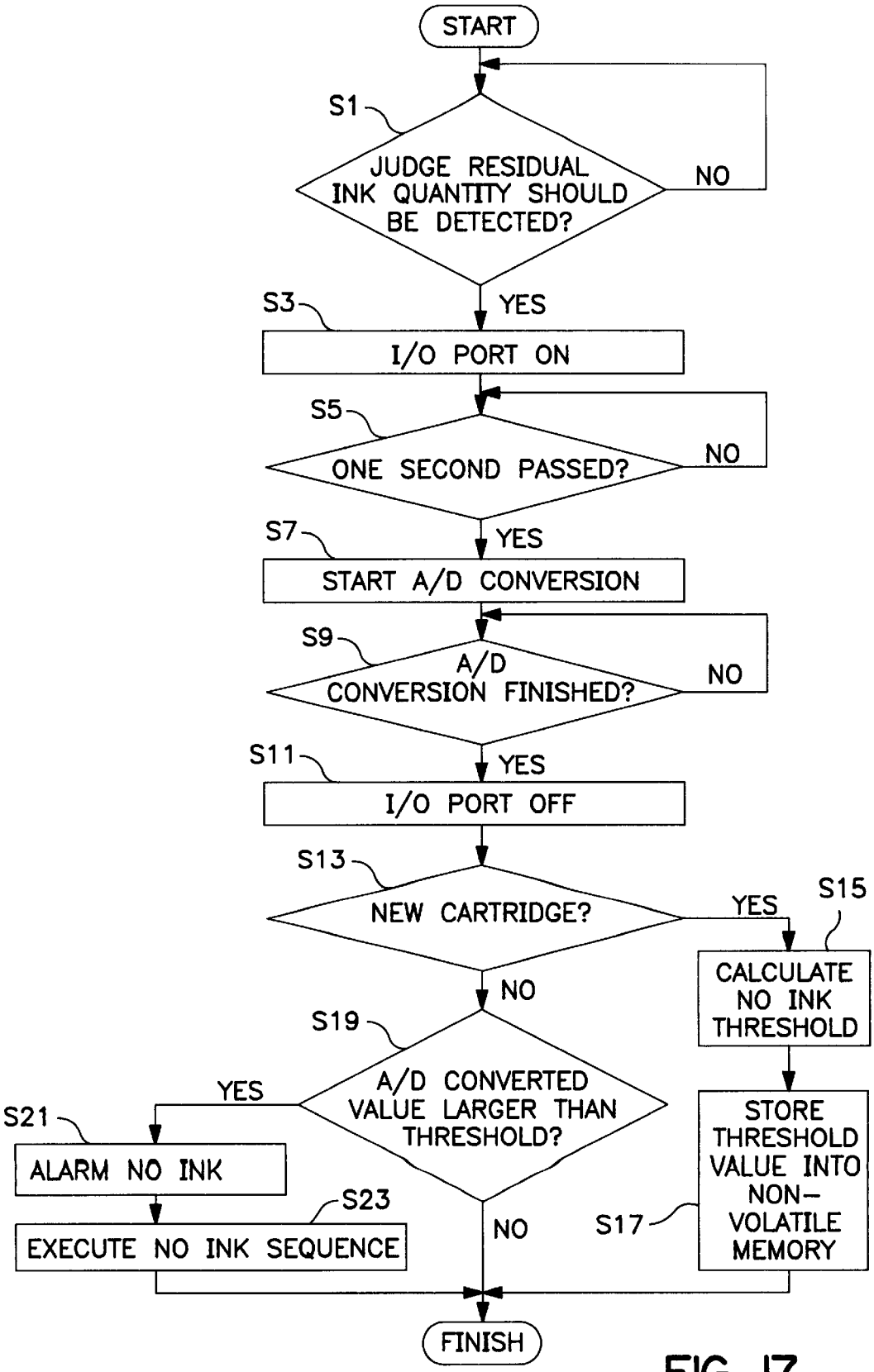
FIG. 17 is a flow chart showing an operational sequence according to the present invention.

FIG. 17 shows one example of treatment sequence according to the residual ink quantity detection by the controlling portion 200, and operation of the circuit shown in FIG. 16 is explained with reference to FIG. 17.

The controlling portion 200 makes a I/O port 1 in a residual ink quantity detecting timing (step 1), and makes a transistor Tr3 ON. As a result, a transistor Tr1 is made ON, and a transistor Tr2 will operate. Here, current Io that flows into the transistor is represented by $$Io=(V_Z-V_{BE})/R_1$$

where $V_{BE}$ respresents voltage for base-emitter, and $V_Z$ is a Zener voltage.

The constant current thus obtained flows directly between both electrodes 105 in the ink tank of head cartridge. Accordingly, corresponding voltage is generated between the electrode 105. After waiting a predetermined time period (for example, one second) which is enough for stabilization thereof (step 5), this voltage is put into an A/D converter inputting terminal of the controlling portion 200 directly or via a voltage converting circuit 400 (step 7). Upon completion of A/D conversion (step 9), the controlling portion 200 makes I/O port and transistors Tr1–Tr3 OFF (step 11), and judges whether this sequence is started by mounting of new cartridge (step 13).

As shown in FIG. 15, since the curved condition can be recognized from data in which the ink is consumed, upon mounting of new cartridge, the controlling portion 200 calculates the threshold for no ink judgement suitable for the cartridge by A/D conversion value, i.e. initial data (step 15), and writes it into the non-volatile memory 300 (step 17).

In the succeeding detecting timing of residual quantity, the presence/absence of residual ink quantity can be judged by simply comparing the threshold calculated upon mounting of new cartridge and stored in the non-volatile memory 300 with the detected residual quantity (step 19). Thus, in the case when no ink residual quantity is detected, alarm is made to the operator to exchange the head cartridge (step 21), and effect the sequence to interrupt operation of various parts, or the like.

Incidentally, it is possible to store only the initial data upon mounting of new cartridge, and calculate the threshold in the succeeding process from the initial data.

As mentioned above, according to this embodiment, even when resistance variation between the electrodes can not be ignored upon detection of the residual ink quantity in the ink tank portion 102, residual quantity detection of high accuracy become possible by calculating the threshold level from which no ink is judged from the initial value of resistance between electrodes by constant current detection, and comparing the data with the substantial detecting data.

In addition, with regard to the change of characteristic resulted from difference of ink and composition, response can be made by adjusting the constant current value.

Embodiment 8

Figure 18:
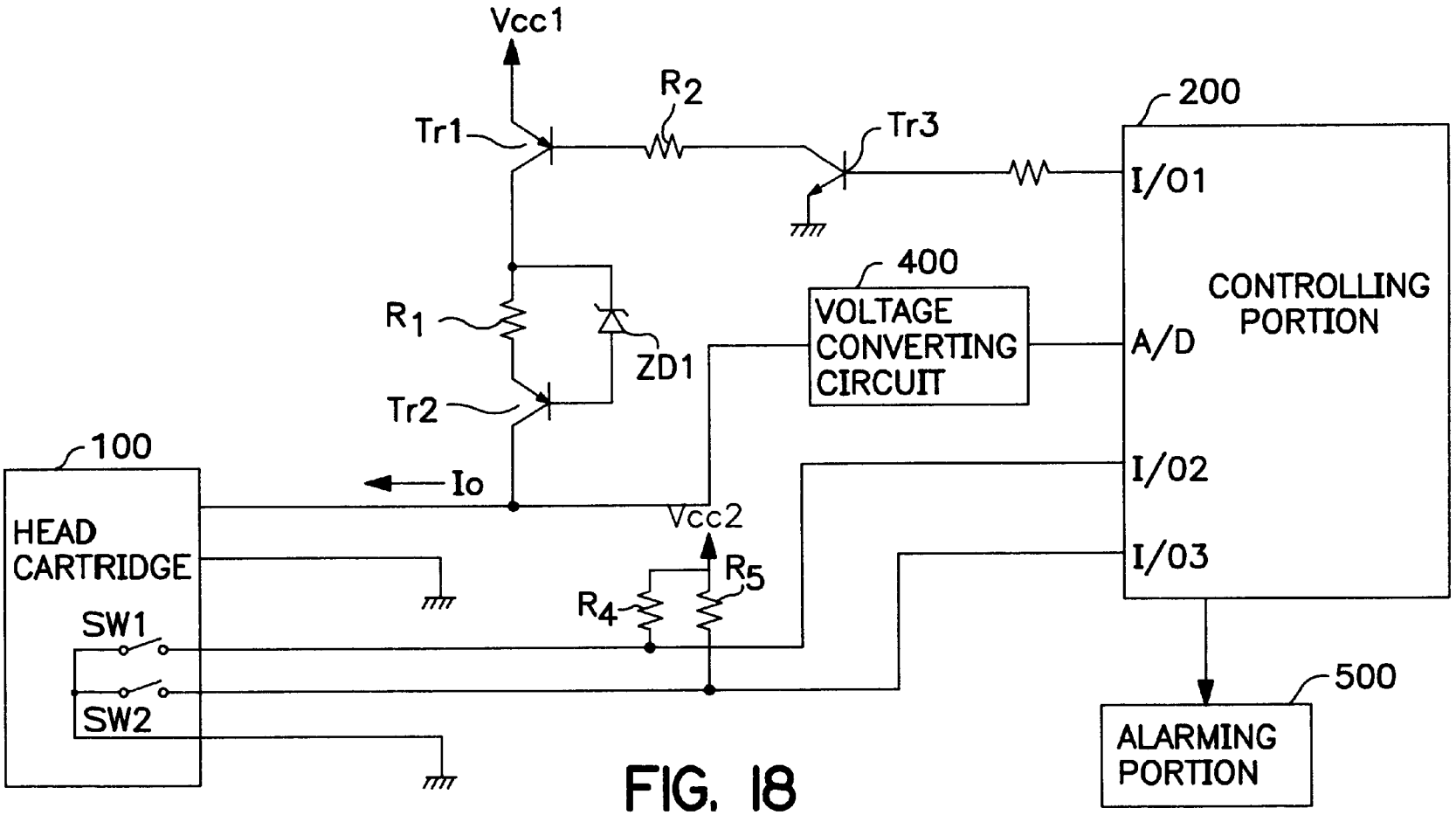
FIG. 18 is a drawing showing still another example of detecting circuit of a residual ink quantity.

FIG. 18 shows another embodiment of the present invention. In FIG. 18, the member or means corresponded to that of FIG. 16 are represented by the same numerals.

In a head cartridge 100, the function corresponding to the switches (SW1 and SW2) is added for classifying the initial variation of the ink resistance. Actually, this can be effected by cutting the pattern formed on the printing plate by laser in the assembling process. In the disclosed embodiment, the information of classification is constructed by 2 bits, that is, to classify the variation into four ranks; an arbitrary predetermined bit number can be adopted, of course.

According to this embodiment, in addition to advantages obtained in the foregoing embodiment, the non-volatile memory 300 shown in FIG. 16 for storing the threshold or initial data become unnecessary since the classifying information is given from the head cartridge, which leads to simple construction of the apparatus and low cost for manufacture. A processing sequence substantially same that of FIG. 17 can be adopted in this embodiment, and the step corresponding to steps S15, S17 becomes unnecessary because the non-volatile memory 300 is not included.

In the above two embodiments, the present invention is applied to the ink jet recording apparatus using the head cartridge made by combining the recording head tip and the ink tank integrally. Of course, the head tip and ink tank may be made separately and the recording head tip need not be disposable.

In addition above explanation is made for the liquid jet recording apparatus of serial type in which the recording head is scanned relative to the recording medium to effect recording, the present invention can be applied to so-called multitype recording apparatus in which the discharge openings are arranged over the entire width of the recording medium, very effectively and easily. In other words, the present invention can be applied to the recording apparatus in which problem of variation of ink supplying source such as the ink tank occurs.

Figure 19:
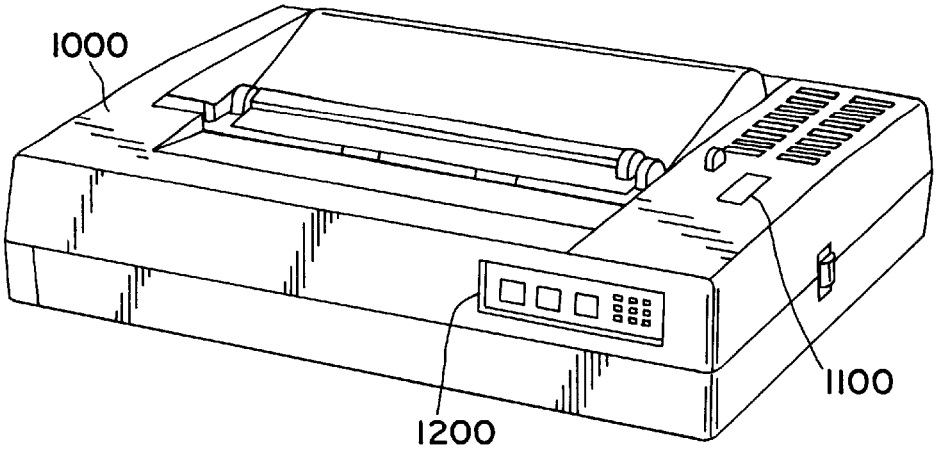
FIG. 19 is a perspective view showing an ink jet recording apparatus according to the present invention.

FIG. 19 is a perspective view showing one example of the ink jet recording apparatus according to the present invention, in which 1000 is a main body of apparatus, 1100 is a power source, and 1200 is an operational panel.

The present invention brings about excellent effects particularly in a recording head, recording device of the bubble jet system among the ink jet recording system.

As to its representative constitution and principle, for example, one practiced by use of the basic principle disclosed in, for example, U.S. Pat. Nos. 4,723,129 and 4,740,796 is preferred. This system is applicable to either of the so called on-demand type and the continuous type. Particularly, the case of the on-demand type is effective because, by applying at least one driving signal which gives rapid temperature elevation exceeding nucleate boiling corresponding to the recording information on an electricity-heat converters arranged corresponding to the sheets or liquid channels holding liquid (ink), heat energy is generated at the electricity-heat converters to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into pulse shapes, growth and shrinkage of the bubble can be effected instantly and adequately to accomplish more preferably discharging of the liquid (ink) particularly excellent in response characteristics. As the driving signals, plus shapes such as those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination constitutions of discharging orifice, liquid channel, electricity-heat converter (linear liquid channel or right angle liquid channel) as disclosed in the above-mentioned respective specifications, the constitution by use of U.S. Pat. Nos. 4,558,333 and 4,459,600 disclosing the constitution having the heat acting portion arranged in the flexed region is also included in the present invention. In addition, the present invention can be also effectively made the constitution as disclosed in Japanese Patent Laid-Open Application No. 59-123670 which discloses the constitution using a slit common to a plurality of electricity-heat converters as the discharging portion of the electricity-heat converter or Japanese Patent Laid-Open Application No. 59-138461 which discloses the constitution having the opening for absorbing pressure wave of heat energy correspondent to the discharging portion.

Further, as the recording head of the full line type having a length corresponding to the maximum width of recording medium which can be recorded by the recording device, either the constitution which satisfies its length by combination of a plurality of recording heads as disclosed in the above-mentioned specifications or the constitution as one recording head integrally formed may be used, and the present invention can exhibit the effects as described above further effectively.

In addition, the present invention is effective for a recording head of the freely exchangeable chip type which enables electrical connection to the main device or supply of ink from the main device by being mounted on the main device, or for the case by use of a recording head of the cartridge type provided integrally on the recording head itself.

Also, addition of a restoration means for the recording head, a preliminary auxiliary means, etc. provided as the constitution of the recording device of the present invention is preferable, because the effect of the present invention can be further stabilized. Specific examples of these may include, for the recording head, capping means, cleaning means, pressurization or aspiration means, electricity-heat converters or another heating element or preliminary heating means according to a combination of these, and it is also effective for performing stable recording to perform preliminary mode which performs discharging separate from recording Further, as the recording mode of the recording device, the present invention is extremely effective for not only the recording mode only of a primary stream color such as black etc., but also a device equipped with at least one of plural different colors or full color by color mixing, whether the recording head may be either integrally constituted or combined in plural number.

As mentioned heretofore, in the ink jet recording apparatus according to the present invention having correcting means for residual ink quantity, erroneous detection is hard to be generated, and the following qualities needed for ink jet recording apparatus can be realized without increasing cost.

(a) The same or common apparatus can be used for various kinds of ink for normal sheet, count sheet and TP.

(b) The same apparatus can be used for different kinds of color inks.

(c) It is possible to respond to change of using environment and continuing printing.

(d) Injury of the heating element due to erroneous detection and bad printing due to non-discharge can be prevented.

In the residual ink quantity detection apparatus detecting the residual ink quantity by resistance of the ink, the ink resistance is corrected at the main body of apparatus, recording head or tank portion, the resistance output characteristic can be kept in constant even if the ink components may vary. Furthermore, accurate residual quantity detection can be effected without exchange of the head even when plural kinds of inks are used. It is also possible to prevent bad printing due to erroneous detection. In detail, from the present invention, the ink jet recording head, ink tank and ink jet recording apparatus capable of effecting stabilized and high accuracy residual ink quantity detection with simple construction can be realized.

What is claimed is:

1. An ink jet recording apparatus comprising:

a detachably mountable ink jet cartridge including an ink jet recording head for ejecting an ink onto a recording medium, and an ink supply source connected to the recording head and containing the ink for supply to the recording head upon recording, the ink supply source having electrodes for passing an electric current through the ink in the ink supply source;

constant current generating means electrically connected to the electrodes for generating a constant current in the electrodes;

exchange detection means for detecting an exchange of said ink jet cartridge;

determining means for determining a threshold based on a resistance value between the electrodes obtained when said constant current generating means generates the constant current in the electrodes in an initial state of said ink jet cartridge wherein said cartridge contains an initial amount of ink when said exchange detection means detects said exchange of said ink jet cartridge;

memory means for memorizing the threshold determined by the determining means; and judging means for judging based on the threshold whether or not the amount of ink in the ink supply source has fallen below a predetermined amount.

2. An ink jet recording apparatus according to claim 1, wherein said determining means calculates a threshold representing a level of the ink unsuitable for recording.

3. An ink jet recording apparatus according to claim 2, further comprising alarm means for connection to said judging means, for receiving an alarm signal therefrom, and for generating an alarm, wherein said judging means provides the alarm signal when the amount of ink has reached the level unsuitable for recording.

4. An ink jet recording apparatus according to claim 3, wherein the alarm is a display.

5. An ink jet recording apparatus according to claim 1, wherein the ink jet recording head has a thermal energy generating element for generating thermal energy to discharge ink.

6. An ink jet recording apparatus according to claim 1, wherein the threshold is determined after a lapse of a predetermined time period after initiation of applying the electric current.

7. A method of detecting a decrease in an amount of ink in an ink supply source for an ink jet recording apparatus comprising a detachably mountable ink jet cartridge including an ink jet recording head for ejecting the ink onto a recording medium, and an ink supply source connected to the recording head and containing ink for supply to the recording head upon recording, the ink supply source having electrodes for passing a constant electric current through the ink in the ink supply, the method comprising the steps of:

detecting an exchange of the ink jet cartridge;

determining a threshold for judging a decrease in an amount of ink in an ink jet cartridge mounted when the ink jet cartridge in place on the apparatus is exchanged, the threshold being based on a resistance value between the electrodes obtained by passing the constant electric current between the electrodes in an initial state of the ink jet cartridge wherein the cartridge contains an initial amount of ink when the exchange is detected in said detecting step; and judging based on the threshold whether or not the amount of ink in the ink supply source has fallen below a predetermined amount.

8. A method according to claim 7, further comprising the step of providing an alarm when the amount of ink has reached a level unsuitable for recording.

9. A method according to claim 8, wherein the alarm is a display.

10. A method of detecting according to claim 7, wherein the threshold is determined after a lapse of a predetermined time period after initiation of passing the electric current through the ink in the ink supply source.

11. An ink jet recording apparatus, comprising:

a main body of said apparatus;

an ink jet head for discharging an ink:

an ink supply source for connection to said ink jet head and for supplying the ink to said ink jet head, said ink supply source being shaped as a disposable cartridge which is removably mounted on said main body of said apparatus;

electrodes provided on said ink supply source;

constant current generation means for electrical connection to said electrodes and for generating a constant current in said electrodes;

exchange detection means for detecting an exchange of the cartridge, the cartridge having an initial amount of ink;

detecting means for electrical connection to said ink supply source and for detecting a reduced state of residual ink amount in said ink supply source based on a change of a voltage value between said electrodes;

holding means, corresponding to said ink supply source, for connection to said detecting means to receive a signal therefrom and for holding the detection data for detecting the reduced state of residual ink amount in said ink supply source; and set means for setting the detection data based on a resistance between said electrodes obtained when said constant current generation means generates the constant current in the electrodes in an initial state of said ink supply source wherein said ink supply source contains an initial amount of ink when said exchange detection means detects the exchange of said cartridge, wherein said detecting means compares the detection data held in said holding means with an actually measured value of the electrical signal between said electrodes to thereby effect the reduced state of residual ink.

12. An ink jet recording apparatus according to claim 11, wherein the detection data is a threshold value set corresponding to said ink supply source and based on a resistance value between said electrodes for detecting the reduced state of residual ink amount, and wherein said holding means comprises a memory means for storing the threshold value.

13. An ink jet recording apparatus according to claim 11, wherein said ink supply source is formed with said ink jet head as a unitary member and is shaped as a disposable cartridge which is removably mounted onto the main body of said ink jet apparatus.

14. An ink jet recording apparatus according to claim 11, wherein said detecting means detects the reduced state of residual ink amount in said ink supply source by detection of a change of current value based on a change between said electrodes.

15. An ink jet recording apparatus according to claim 11, wherein said detecting means detects the reduced state of residual ink amount in said ink supply source from detection of a change of the voltage value based on a change of resistance between said electrodes.

16. An ink jet recording apparatus according to claim 11, wherein said ink jet head includes an electrical/thermal conversion element as an energy generating member for generating thermal energy for discharging the ink.

17. An apparatus according to claim 11, further comprising exchange detection means for detecting an exchange of said ink supply source, and wherein said set means sets the detection data when exchange of the ink supply source is detected by said exchange detection means.

18. An ink jet recording apparatus according to claim 11, wherein the electrical signal of the voltage value is detected after a lapse of a predetermined time period after initiation of the constant current.

19. A detecting method for detecting a reduced state of a residual ink amount in an ink supply source by a change of an electrical signal based on a change of resistance between electrodes provided in the ink supply source, said ink supply source storing the ink for supply to an ink jet head discharging the ink and being shaped as a disposable cartridge removably mounted on a main body of an ink jet apparatus, said method comprising the steps of:

detecting an exchange of the cartridge;

detecting the electrical signal based on the resistance between the electrodes by flowing a constant current to the ink supply source having an initial amount of ink, when the exchange of said cartridge is detected;

setting detection data based on the electrical signal detected in said step of detecting the electrical signal;

measuring an actually measured value of the electrical signal between the electrodes; and detecting the reduced state of residual ink amount in the ink supply source by comparing the detection data with the actually measured value of the electrical signal between the electrodes.

20. A detecting method according to claim 19, wherein the detection data is a threshold value of a voltage value set corresponding to the ink supply source and based on the resistance between the electrodes for detecting the reduced state of residual ink amount.

21. A detecting method according to claim 19, wherein the detection data is a threshold value of the electrical signal between the electrodes shown by information corresponding to the ink supply source.

22. A detecting method according to claim 19, wherein the ink supply source is formed with said ink jet head as a unitary member and is shaped as a disposable cartridge removably mounted on the main body of the ink jet apparatus.

23. A detecting method according to claim 19, wherein the ink jet head includes an electrical/thermal conversion element as a energy generating member for generating thermal energy for discharging the ink.

24. A method according to claim 19, further comprising a step for detecting an exchange of the ink supply source, and a step for setting the detection data by the voltage value based on the resistance value upon flowing the constant current between the electrodes, when exchange of the ink supply source is detected by said exchange detecting step.

25. A detecting method according to claim 19, wherein the detection data is formed in said forming step after a lapse of a predetermined time period after initiation of the constant current.

* * * * *

UNITED STATES PATENT AND TRADEMARK OFFICE

CERTIFICATE OF CORRECTION

PATENT NO. : 5,988,783

DATED : November 23, 1999

INVENTORS : HIROSHI TAJIKA, et al.

It is certified that error appears in the above-identified patent and that said Letters Patent is hereby corrected as shown below:

ON THE COVER

Under Related U.S. Application Data, "Pat. No. 5,162,817," should read --Pat. No. 5,162,817, Nov. 10, 1992,--

COLUMN 1

Line 38, "hereinafter)" should read -- hereinafter))--.

COLUMN 2

Line 2, "is occurred" should read --may be--.

COLUMN 3

Line 66, "component" should read --components--.

COLUMN 5

Line 38, "and" should read --or--.
Line 67, "a" should read --∝--.

UNITED STATES PATENT AND TRADEMARK OFFICE

CERTIFICATE OF CORRECTION

PATENT NO. : 5,988,783

DATED : November 23, 1999

INVENTORS : HIROSHI TAJIKA, et al.

It is certified that error appears in the above-identified patent and that said Letters Patent is hereby corrected as shown below:

COLUMN 6

Line 1, "B" should read --β--.

COLUMN 7

Line 42, "is" should read --its--.
Line 63, "elements" should read --element--.

COLUMN 8

Line 23, "a direction or B" should read --∝ direction or β--.

COLUMN 9

Line 25, "of" should read --of the--.
Line 40, "and from which" should be deleted; and "the cartridge of" should read --is from the--.

COLUMN 10

Line 49, "a" should read --an--.

UNITED STATES PATENT AND TRADEMARK OFFICE

CERTIFICATE OF CORRECTION

PATENT NO. : 5,988,783

DATED : November 23, 1999

INVENTORS : HIROSHI TAJIKA, et al.

It is certified that error appears in the above-identified patent and that said Letters Patent is hereby corrected as shown below:

COLUMN 11

Line 58, "same" should read --the same as--.

COLUMN 12

Line 39, "plus" should read --pulse--.

COLUMN 14

Line 42, "supply," should read --supply source,--.

Signed and Sealed this

Twentieth Day of March, 2001

*Attest:*

Nicholas P. Godici

NICHOLAS P. GODICI

*Attesting Officer*

*Acting Director of the United States Patent and Trademark Office*